US006111485A

United States Patent [19]

Carlsson et al.

[11] Patent Number: 6,111,485

[45] Date of Patent: Aug. 29, 2000

[54] ARRANGEMENT AND METHOD RELATING TO FILTERING OF SIGNALS

[75] Inventors: Erik Carlsson, Mölndal; Spartak Gevorgian, Göteborg; Erik Kollberg, Lindome; Peter Linner, Mölndal; Erland Wikborg, Danderyd, all of Sweden

[73] Assignee: Telefonaktiebolaget LM Ericsson, Stockholm, Sweden

[21] Appl. No.: 09/100,168

[22] Filed: Jun. 18, 1998

Related U.S. Application Data

[63] Continuation of application No. PCT/SE96/01688, Dec. 19, 1995.

[30] Foreign Application Priority Data

Dec. 19, 1995 [SE] Sweden ..... 9504530

[51] Int. Cl.[7] ..... H01P 1/201; H01P 7/10

[52] U.S. Cl. ..... 333/995; 333/235; 505/210; 505/701

[58] Field of Search ..... 333/995, 235, 333/219, 205; 505/210, 700, 701, 866

[56] References Cited

U.S. PATENT DOCUMENTS

| | | | |
|---|---|---|---|
| 4,727,342 | 2/1988 | Ishikawa et al. | 333/204 X |
| 4,835,498 | 5/1989 | Rouger et al. | 333/205 |
| 5,172,084 | 12/1992 | Fiedziuszko et al. | 333/204 |
| 5,496,796 | 3/1996 | Das | 505/210 |

FOREIGN PATENT DOCUMENTS

| | | |
|---|---|---|
| 0 567 407 | 10/1993 | European Pat. Off. . |
| 93/00720 | 1/1993 | WIPO . |
| 94/13028 | 6/1994 | WIPO . |

OTHER PUBLICATIONS

Vendik, O. "1 Ghz Tunable Resonator on Bulk Single Crystal $SrTiO_3$Plated with $YBa_2Cu_3O_{7-c}$ Films" vol. 31, No. 8, pp. 654–656, Apr. 13, 1995.

Krupka et al., "Dielectric Properties of Single Crystals of $A1_2O_3$, $LaA1O_3$ , $SrTiO_3$ , and MgO at Cryogenic Temperatures", IEEE Trans. Microwave Theory Technoloy, 1994, vol. 42, pp. 1886–1890.

*Primary Examiner*—Justin P. Bettendorf

*Attorney, Agent, or Firm*—Burns, Doane, Swecker & Mathis, L.L.P.

[57] ABSTRACT

A superconducting notch or band reject filter arrangement includes a superconducting dielectric resonator and a waveguide arrangement including a microstrip line to which the resonator is connected. The resonator is a parallel-plate resonator with a chip of a non-linear dielectric material device on which superconductors are arranged and the waveguide arrangement includes a contact device or a coupling device, the resonator being connected to the contact device of the waveguide arrangement in such a way that electric contact is provided, and the filter arrangement is frequency tuneable. Through the arrangement, the insertion losses are low.

30 Claims, 4 Drawing Sheets

ARRANGEMENT AND METHOD RELATING TO FILTERING OF SIGNALS

This application is a continuation of International Application No. PCT/SE96/01688, which was filed on Dec. 19, 1995, which designated the United States, and which is expressly incorporated here by reference.

BACKGROUND

The present invention relates to superconducting filter arrangements, particularly notch filters or band reject filters which comprise a superconducting dielectric resonator and a waveguide arrangement such as e.g. a microstrip line.

One of the applications of notch filters or band reject filters is within communications systems. A particular application of such relates to multichannel microwave communications systems which operate in high frequency bands in which the size of the components is highly important.

The invention also relates to a method for filtering signals incoming to a receiving arrangement in a multichannel communication system.

Since for example frequency multiplexers, band reject filters etc. are among the key elements in multichannel communication systems, efforts have been made to find a way to reduce the insertion losses and the size of these components. For multichannel microwave communication systems operating in the 1–3 GHz frequency band insertion losses are high for presently used devices.

It is known to use YIG (Yttrium Iron Garnet) notch filters in the front end of microwave receivers to blank out intermittent interfering signals. However, the insertion losses are high. Moreover the size of such filters is large. In "High-Temperature Superconducting Microwave Devices", by Shen, Artech House, 1994 the use of high temperature superconductors is discussed for providing new possibilities to reduce the size and to improve the performance of microwave components, for example filters.

European Patent Application EP-A-0 567 407 discloses superconducting notch filters with a fixed frequency wherein half wavelength, high temperature superconducting microstrip resonators are parallel coupled to the main high temperature superconducting microstrip line. The substrates of the resonators have dielectric constants of about 10–25 at frequencies between 1–3 GHz. The length of the filters is then about 2–6 cm; the filters are thus very large and they are also expensive.

In some communication systems tuneable (switchable) notch filters are required instead of fixed frequency notch filters e.g. in order to increase the flexibility of the system. U.S. Pat. No. 4,834,498; and shows a simple dielectric resonator. The resonator is passive and it is not itself tunable. To provide tunability additional tuning means are required such as a diode. In other words, a separate biasing circuit is required. This considerably adds to the size of the arrangement. Furthermore, the device as such gets complex and the performance is not sufficiently high. In WO 93/00720 a superconducting notch filter with a microstrip resonator which is not tunable itself is illustrated. In this case optical means are used to provide tuning, which use semiconductor crystals in superconducting microstrip ring resonators coupled to the main superconducting microstrip. However, the dimensions of these arrangements are large and moreover the frequency tuning range is much too small. Both of the above mentioned documents show passive resonators and devices requiring a special bias network and additional tuning means which are coupled to a main microstrip line in the same way. The resonators cannot be in mechanical or electrical contact with the main microstrip line. If there is no coupling, there is no filter.

To summarize, both these devices need additional tuning means with a separate biasing circuit. That makes the designs large as well as complex. Furthermore, the electrical performance of the filter is negatively affected therethrough and it is also as such not as high as would be desired. For example frequencies of about 1–3 GHz the devices as disclosed in these documents would be much too large and they cannot for example be used for telecommunication purposes.

It has also been found that microwave devices can be made smaller if high dielectric constant non-linear dielectric materials such as for example Strontium Titanate (STO) are plated with superconductors such as e.g. Y—Ba—Cu—O (YBCO). WO 94/13028 discloses the use of thin single crystalline dielectric films in combination with high temperature superconductors which as such however produce too high microwave losses and moreover such devices cannot be made small enough.

SUMMARY

What is needed is therefore a superconducting notch filter arrangement which has low insertion losses, small dimensions and which is tuneable. Particularly an arrangement is needed which is tuneable within a large frequency range. Moreover an arrangement is needed which is cheap and easy to fabricate. Still further an arrangement is needed which has a high performance as stated above has low losses, particularly low microwave losses (in the case of microwaves); it can also be used for millimeter-waves.

A method for filtering signals incoming to for example receiving arrangements in a multichannel microwave communication system operating at high frequencies is needed through which intermittent and interfering signals can be blanked out in an efficiant and reliable manner.

Therefore a superconducting notch filter arrangement is provided which comprises a resonator arranged on a microstrip line wherein the resonator is a parallel-plate resonator with a chip of a non-linear dielectric material on which superconductors are arranged. The resonator is connected to connecting means of a microstrip line or a strip of the microstrip line in such a way that an ohmic contact is provided. Through the use of a parallel-plate resonator it can be arranged on top of a microstrip line, coupling is provided and the dimensions can be reduced. No special bias network is needed and no additional tuning means. The arrangement is particularly electrically tuneable, still more particularly through the application of a DC biasing voltage to the non-linear dielectric of which the dielectric material constant can be changed. In a particular embodiment a DC voltage is applied to normal conductors which may be arranged on the superconductors arranged on the dielectric material of the resonator. Advantageously contact means, also denoted coupling means, are arranged to provide for dielectric material contact between the resonator and the microstrip line. In an advantageous embodiment the contact means are formed by the central strip of the microstrip line.

In a particular embodiment a resonator comprises a rectangular (or some other shape) chip which is so oriented in relation to the microstrip line that the magnetic field lines of the microstrip line and the resonator substantially coincide in such a way that maximum inductive coupling is produced.

The inductive coupling is particularly controlled or given by the relation between the resonator and microstrip line.

Even more particularly the strength of the inductive coupling is given by the width of the central microstrip. To obtain the desired strength of coupling, the width can thus be given the value which provides the desired coupling.

According to a particular embodiment at least a portion of the lower plate of the parallel-plate resonator and/or the microstrip connecting means, for example the central strip, has/have a first width that is smaller than a second width in order to provide an increased inductive coupling.

According to one embodiment the resonator is a dual mode resonator or even more particularly it is a multimode resonator.

However, dual mode operation is advantageously produced through the introduction of an asymmetry in the resonator. This asymmetry may for example comprise a cut away corner or a protrusion or anything else. According to another embodiment the resonator may be arranged so as to form an angle with the main microstrip line. The angle may for example take the value of approximately 45°.

According to still another embodiment the waveguiding arrangement may comprise a coplanar waveguide. The coupling strength is controlled by or given by the width of the central strip and of the coplanar waveguide slots.

The tuning is advantageously provided (which relates to all embodiments) through the application of a DC biasing voltage which may be applied between the upper plate of the resonator and the coupling means, e.g. the central strip of the microstrip line.

According to an advantageous embodiment the area of the resonator may have a size between approximately 1 $mm^2$–1 $cm^2$. However, these values are merely given for exemplifying reasons, the resonator may also have other proportions, smaller as well as somewhat bigger.

Furthermore a method is given for filtering signals incoming to for example a receiving arrangement of a multichannel communication system or similar. The method comprises the steps of: arranging a filter on the input side of a receiving arrangement, which filter comprises a parallel-plate resonator comprising a non-linear dielectric material on which superconductor plates are arranged, which is arranged on a waveguide, e.g. a microstrip line. The resonator and the waveguide arrangement are connected electrically in series through the use of coupling means. The coupling strength is given by how the resonator and the coupling means are arranged in relation to each other. A DC biasing voltage is applied to the resonator and the coupling means for frequency tuning. The steps are carried out so that intermittent interfering signals can be blanked out.

It is among others an advantage of the invention that it is possible to make notch or band reject filters having dimensions which are considerably smaller and more compact than hitherto known filters. It is also an advantage that the frequency tuning range is large. Furthermore, it is an advantage that the resonator is tunable itself so that no additional or separate tuning means are needed.

It is also an advantage that it is less complex than known arrangements and that it can be made small enough to be used in telecommunications systems.

BRIEF DESCRIPTION OF THE DRAWINGS

The invention will in the following be further described in a non-limiting way under reference to the accompanying drawings in which.

DETAILED DESCRIPTION

Figure 1:
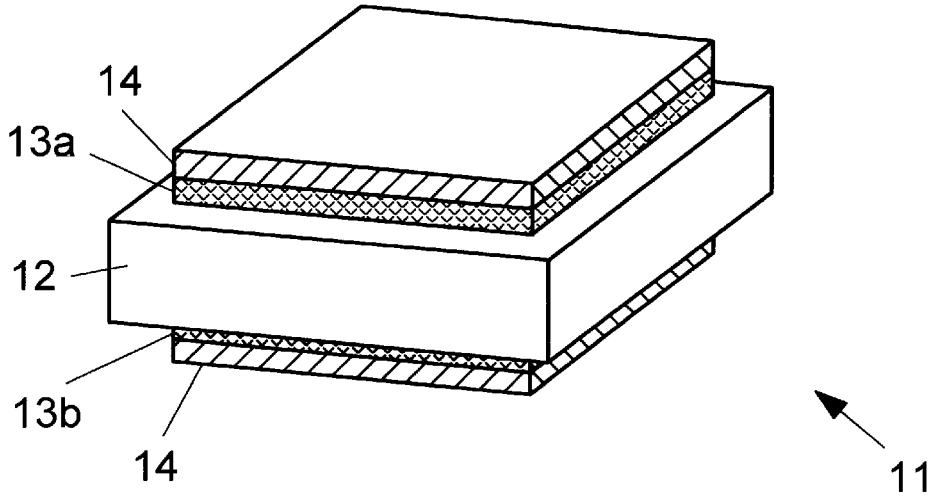
FIG. 1 illustrates an example of a parallel-plate resonator.

According to the invention a resonator is arranged on a waveguide arrangement. FIG. 1 shows a first example of a parallel-plate resonator that can be used. The resonator 11 comprises a dielectric material 12 in the form of a rectangular chip of a non-linear dielectric material on both surfaces of which thin high temperature superconducting HTS films 13*a*, 13*b* are arranged. One of the plates of the resonator is connected electrically, DC, (R=O) to the microstrip line (not shown). Magnetic coupling means or DC contact means are arranged in such a way that the filter rejection band and central frequency can be electrically controlled. The superconducting films or plates 13*a*, 13*b* may advantageously be partly or completely covered by normal conducting films 14 for example of Au thus forming ohmic contacts for DC biasing. According to an advantageous embodiment, the dielectric material comprises a non-linear dielectric bulk material since for bulk material the microwave losses are lower and the dielectric constant is higher than for example for thin dielectric films. Through the use of a non-linear dielectric material, electrical controlling is enabled.

The microwave losses of for example Strontium Titanate, hereinafter referred to as STO are close to minimum at the temperature of liquid nitrogen, $N_{liq}$ which is discussed in "Dielectric properties of single crystals of $Al_2O_3$, $LaAlO_3$, $NdGaO_3$, $SrTiO_3$ and MgO at cryogenic temperatures", by Krupka et al., in IEEE Trans. Microwave Theory Techn., 1994, Vol. 42, pp. 1886–1890. The dielectric constant of STO is about 2000 at the temperature of $N_{liq}$ and it is strongly dependent on temperature and on applied electric DC fields. This is discussed in "1 GHz tuneable resonator on bulk single crystal $SrTiO_3$ plated with $YBa_2Cu_3O_{7-c}$ films", by O. Vendik in Electronics. Lett., 1995, Vol. 31, No. 8, pp. 654–656. Since the dielectric constant is extremely high, the wavelength in a microwave transmission line based on STO at the temperature for $N_{liq}$ in the frequency band 1–3 GHz is about 0.2–0.6 cm. The superconducting transition temperature $T_c$ for HTS such as for example YBCO is well above the temperature of $N_{liq}$ and it is also well known that HTS films grown on STO substrates have a low surface resistance which is discussed in the article cited above by Shen. The resonator may advantageously comprise a non-linear bulk dielectric material 12 e.g. by STO which is covered by HTS films of e.g. YBCO. Of course it is also possible to make the resonators in other ways, but this relates to a particularly advantageous embodiment. If e.g.

STO and superconductors are used, the microwave losses are very low. The superconducting films or plates 13*a*, 13*b* of the parallel-plate resonator are made slightly smaller than the dielectric chip 12 in order to account for mechanical tolerences and for the provision of an improved ability of controlling the resonant frequency. The thickness of the superconducting plates 13*a*,13*b* exeeds the London penetration depth, the penetration depth being defined as the depth at which the field has decreased to 1/e of the value at the surface.

Figure 2:
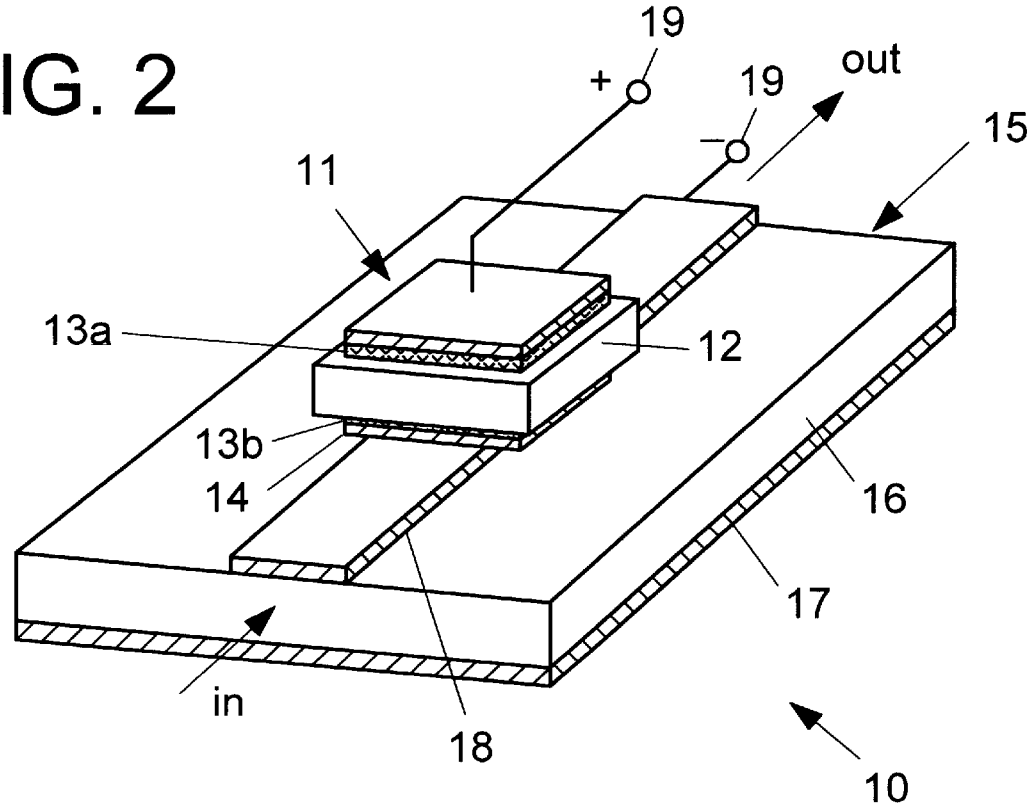
FIG. 2 schematically illustrates a first embodiment of a tuneable notch microstrip filter.

FIG. 2 shows a first embodiment of a tuneable notch filter 10 according to the invention. The resonator 11 of FIG. 1 is arranged on a waveguiding arrangement 15 in the form of a microstrip line. The resonator 11 is in this embodiment connected to or attached to the central strip 18 of the microstrip line 15 wherein the central strip 18 acts as the contact means or couplings means providing ohmic contact between the lower plate 13*b* of the parallel-plate resonator 11 and the microstrip line 15. No special bias network, no additional tuning means are required. The microstrip line 15 comprises a substrate e.g. of Al or any other known dielectric material for $\mu$w-strips. The ground plane 17 comprises e.g. Cu, Au or anything similar having normal conductivity. However, in a very advantageous embodiment the ground plane 17 and the central strip 18 comprise HTS films. The parallel-plate resonator chip 11 is so arranged in relation to the microstrip line 15 that the magnetic field lines of the microstrip 18 and the resonator 11 substantially coincide (FIG. 3) thus ensuring a high degree of inductive coupling, or more precisely maximum inductive coupling. The width of the central microstrip 18 determines the coupling strength between the resonator 11 and the microstrip line 15 and thus the coupling strength can be controlled through choosing the appropriate width. The width can in advantageous embodiments be approximately in the range between 0.5 to 1, but it can also have a smaller or larger width. Thus, in this way a series resonant circuit is introduced into the microstrip line 15 which then acts as a band reject filter, i.e. a notch filter for input microwave signals. Connection means 19 are provided with a positive terminal (+) and a negative terminal (−) through which a DC biasing voltage can be applied between the microstrip and the upper plate 13*a* of the parallel-plate resonator 11. In this way electrical tuning is provided and the DC biasing voltage applied to the non-linear dielectric 12 changes the dielectric constant thereof and thus the resonant frequency of the parallel-plate resonator 11.

One of the resonator plates is advantageously in mechanical or electrical contact with the main microstrip line. The main microstrip is advantageously used as a bias terminal for DC-biasing. This is in contrast to, for example, U.S. Pat. No. 4,835,498, and WO-A-93/00720, wherein the resonator could not be in contact with a main microstrip line.

According to another embodiment, not further discussed herein, temperature controlled tuning can be applied either in addition to the electrical tuning or as an alternative thereto. Optical or mechanical (e.g. via piezoelectric means) tuning can of course also be used.

Figure 3:
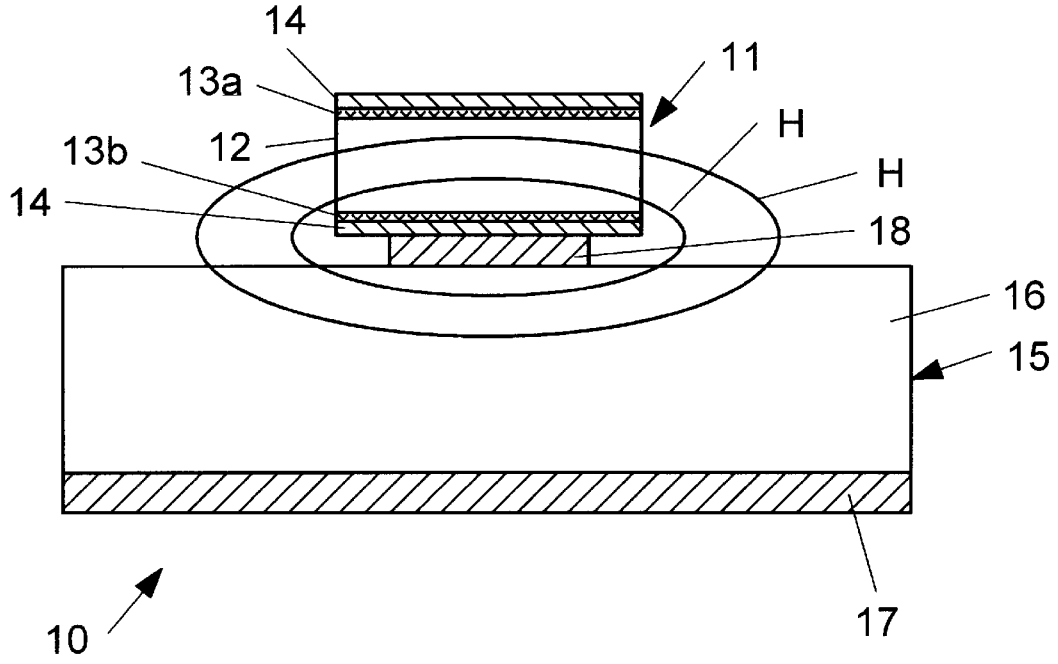
FIG. 3 is a cross-section of the notch filter of FIG. 2.

FIG. 3 is a cross-sectional view of the notch filter 10 as illustrated in FIG. 2. The parts of FIG. 3 corresponding to those of FIG. 2 are identified by the same reference numerals and thus will not be further described. It shows how the resonator 11 is arranged on the central microstrip 18 of the microstrip line 15. H denotes the magnetic field lines of the resonator and of the microstrip line. As discussed above, the magnetic field lines substantially coincide thus providing a high degree of coupling between the resonator 11 and the microstrip line 15.

Figure 4:
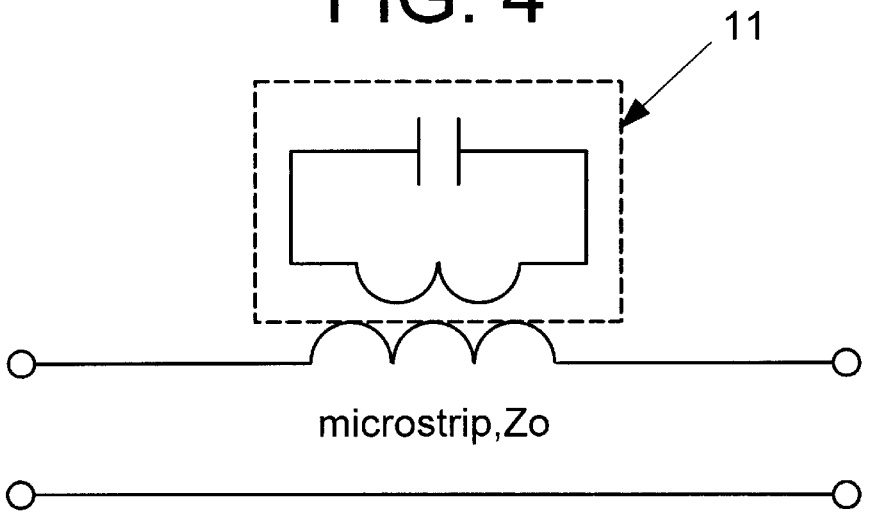
FIG. 4 illustrates an equivalent circuit of the notch filter of FIG. 2.
Figure 5:
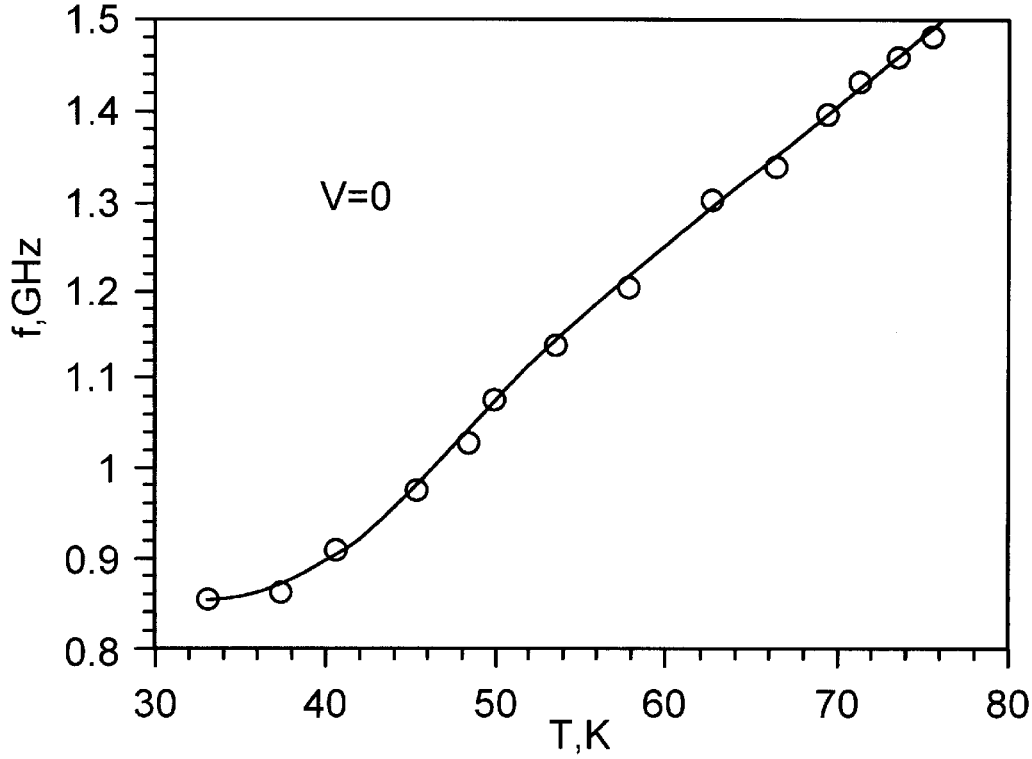
FIG. 5 is a diagram illustrating the temperature dependence of the central frequency of a particular notch filter, FIG. 6*a* schematically illustrates a cross-section of a second embodiment of a notch filter.

FIG. 4 schematically shows an equivalent circuit of the notch filter 10 as illustrated in FIGS. 2 and 3 above. $Z_0$ indicates the impedance of the microstrip whereas the dashed line is the circuit representation of the resonator 11. In a particular embodiment, the resonator is a STO resonator plated with YBCO films as discussed above and the dielectricum in this particular embodiment has the dimensions 2.5×2.5×0.5 $mm^3$. In this embodiment the waveguide arrangement comprises a 50 Ohm copper microstrip on a 0.5 mm aluminium substrate. Of course this is only one example and other materials can be used, the dimensions can be different etc. Moreover, the parallel-plate resonator does not have to be rectangular but it can also take other forms, square shaped, an oval etc. However, FIG. 5 shows a diagram of the temperature dependence of the center frequency of a notch filter having the above mentioned dimensions and no biasing voltage is applied.

Figure 6A:
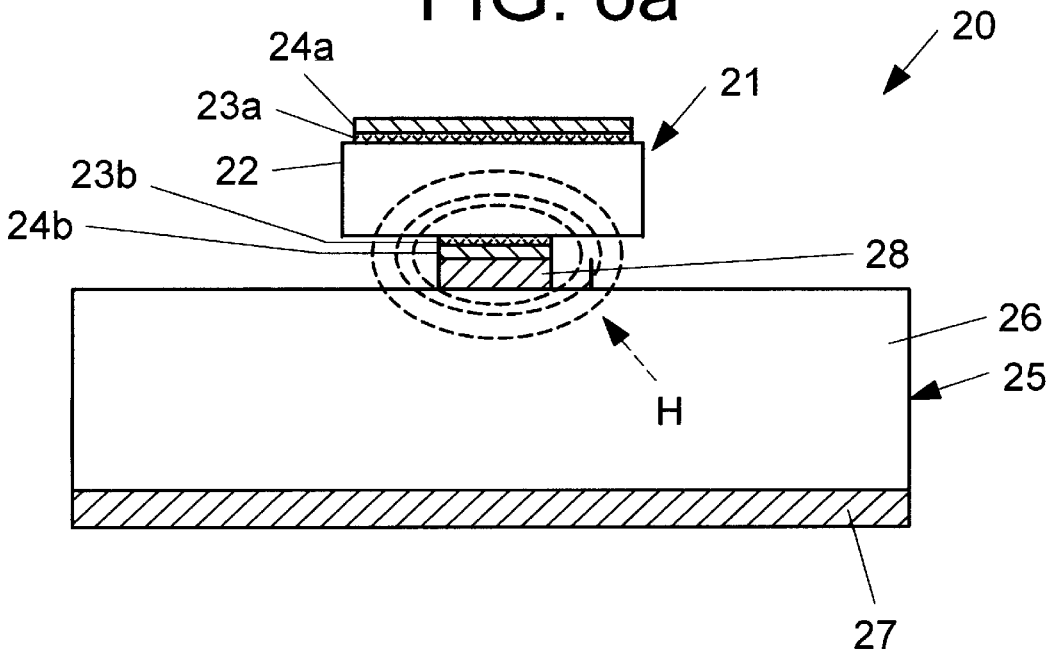
FIG. 6*b* is a longitudinal cross-section of the lower plate of the resonator.
FIG. 6*c* is a longitudinal cross-section of the central microstrip line of the filter according to FIG. 6*a,*
Figure 6C:
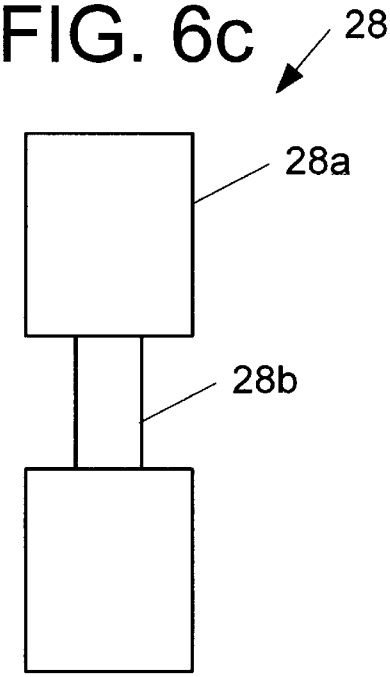
Figure 6B:
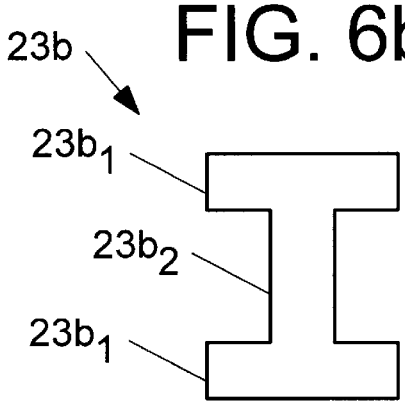

In FIG. 6*a* an alternate embodiment of a notch filter 20 is illustrated. A resonator 21, also in this case comprising a non-linear dielectric bulk material 22 plated with thin superconducting films 23*a*, 23*b* which in turn are covered by normal conducting layers 24*a*, 24*b* for example from Au, is arranged on a microstrip line 25. The microstrip line 25 comprises a substrate for example of Al. On one of its surfaces e.g. a copper microstrip 27 is arranged whereas on the other side of the substrate a central microstrip 28 is arranged. The central microstrip 28 forms the contact means or the connection means between the resonator 21 and the microstrip line 25. H denotes the magnetic field lines of the resonator and of the microstrip line. In this embodiment, as shown in FIG. 6*b*, an inductive loading is provided through a second section $\mathbf{23}b_2$ of the lower resonator plate 23*b* having a smaller width then a first section $\mathbf{23}b_1$. Also the microstrip 28, as shown in FIG. 6*c*, is provided with a second section 28*b* the width of which is smaller than the width of the first section 28*a*. FIGS. 6*b* and 6*c* are longitudinal views seen from above of the lower plate of the resonator and the microstrip respectively, the arrangement which is illustrated in FIGS. 6*a* and 6*b*, respectively, indicating the portions $\mathbf{23}b_2$ and 28*b* each having a smaller width.

Figure 7:
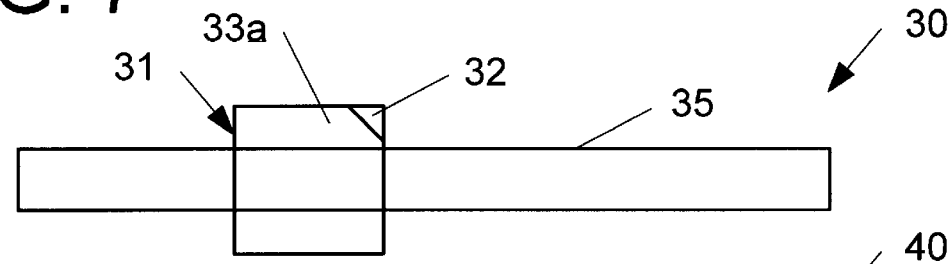
FIG. 7 illustrates an embodiment of a two-pole notch filter.

FIG. 7 very schematically illustrates a two-pole notch filter 30. A resonator 31 (e.g. as discussed under reference to previous embodiments) is arranged on a microstrip line 35. One of the corners of the upper superconducting film 33*a* is cut away; thus producing an asymmetry in the resontor. 32 indicates the dielectric material. Since one of the corners of the upper superconducting film 33*a* is cut off, it is achieved that the resonator 31 can operate in a dual mode. Thus the width of the rejection band and its skirts can be adapted to the current needs.

Figure 8:
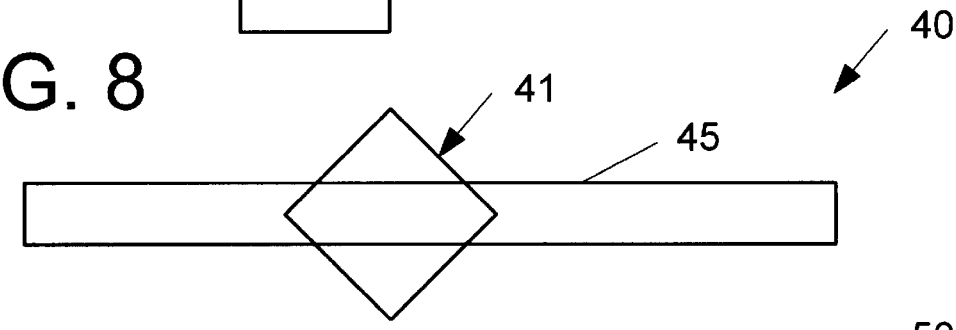
FIG. 8 is a further embodiment relating to a two-pole notch filter.

FIG. 8 shows still a further embodiment of a two-pole notch filter 40. In this case a resonator 41 is arranged on the microstrip line 45 in such a way that it forms an angle with the microstrip line. In this particular case the parallel-plate resonator 41 forms an angle of 45° with the main microstrip. Since an asymmetry is introduced, the resonator also in this case operates in dual mode. The angle does of course not have to be 45° but it can take a higher as well as a lower value; in principle any angle but 90°.

The invention can in principle also be applied to multimode filters for example operating in three modes. Such an arrangement is illustrated in the at the same time filed Swedish Patent Application "Arrangements and methods relating to multiplexing/switching" having the same applicant, the subject matter of which is incorporated herein by reference.

Figure 9:
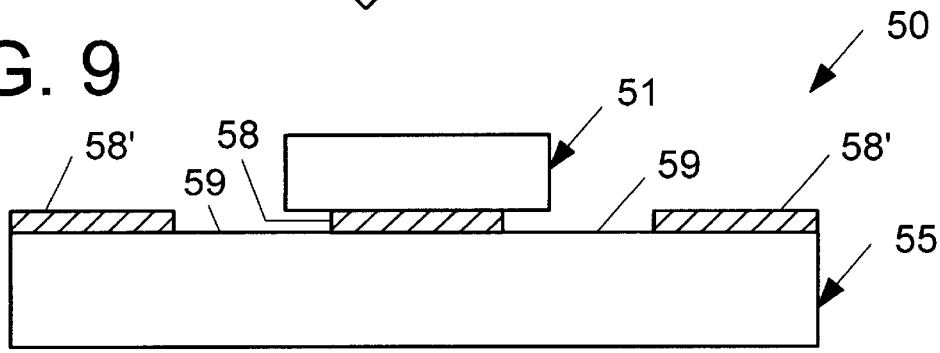
FIG. 9 schematically illustrates a coplanar waveguide notch filter.

FIG. 9 schematically illustrates yet another embodiment comprising a coplanar waveguide (CPW) tuneable notch filter 50, which also can be dual mode operating. A superconducting parallel-plate resonator 51 is attached to the central strip 58 of a coplanar waveguide (CPW) 55 in order to provide for a higher degree of design flexibility. The coupling strength and the wave impedance of the coplanar waveguide 55 is given by the width of the central strip 58 and the slots 59 of the CPW. In general the width of the central strip can take the values as discussed earlier under reference to FIG. 2 (which also applies to the other embodiments) but in this case the flexibility is even higher. The width is generally chosen depending on the substrate thickness. Corresponding strips 58' are also attached to CPW 55.

The invention is not limited to the shown embodiments but other materials can be used, for example it does not have to be a bulk dielectric material, in some cases also thin dielectric materials can be used. Moreover the form of the resonator can be of different kinds as well as the waveguiding means can take a number of different forms and it does not necessarily have to be a central strip of a microstrip line that forms the coupling means.

What is claimed is:

1. Superconducting filter arrangement comprising a superconducting dielectric resonator and a waveguide arrangement comprising a microstrip line to which the resonator is connected, wherein the resonator is a finite parallel-plate resonator made of a non-linear dielectric material that has a high dielectric constant on which superconducting plates are arranged, wherein the resonator has finite extensions and the waveguide arrangement comprises a microstrip line magnetically coupled to one of the plates of the resonator via contact means, the resonator being connected to said contact means of the waveguide arrangement in such a way that electric contact is provided and the filter arrangement is frequency tunable.

2. Superconducting filter arrangement according to claim 1, wherein the filter arrangement is electrically tunable.

3. Superconducting filter arrangement according to claim 2, wherein a DC biasing voltage, via connection means, is directly or indirectly applied to plates of the non-linear dielectric material to change the dielectric constant thereof.

4. Superconducting filter arrangement according to claim 3, wherein conductors are arranged on the resonator outer sides.

5. Superconducting filter according to claim 1, wherein one of the resonator plates is electrically connected or magnetically coupled to the microstrip line.

6. Superconducting filter arrangement according to claim 1, wherein the contact means comprises a central strip of the microstrip line, and the resonator is connected to said central strip.

7. Superconducting filter arrangement according to claim 1, wherein the parallel-plate resonator comprises a substantially rectangular chip.

8. Superconducting filter arrangement according to claim 7, wherein the resonator chip is so oriented in relation to the microstrip line that maximum inductive coupling is achieved.

9. Superconducting filter arrangement according to claim 8, wherein the resonator chip is so oriented in relation to the microstrip line that the magnetic field lines of the microstrip and the resonators substantially coincide.

10. Superconducting filter arrangement according to claim 1, wherein the inductive coupling between the resonator and the microstrip line is given by the relation between the resonator and the microstrip and by the relation between the physical dimensions thereof.

11. Superconducting filter arrangement according to claim 10, wherein the strength of the inductive coupling is determined by the width of the contact means.

12. Superconducting filter arrangement according to claim 1, wherein in order to increase the inductive coupling between the resonator and microstrip line, the lower plate of the parallel-plate resonator or microstrip connecting means each comprises a second portion having a width that is smaller than that of a first width portion, respectively.

13. Superconducting filter arrangement according to claim 1, wherein the resonator is a dual mode operating resonator, and the filter arrangement comprises a two-pole filter.

14. Superconducting filter arrangement according to claim 13, wherein the resonator comprises an asymmetry to provide the dual mode operation.

15. Superconducting notch filter arrangement according to claim 14, wherein the asymmetry comprises a cut-away corner of a plate of the resonator, a protruding portion of the resonator.

16. Superconducting filter arrangement according to claim 13, wherein the resonator is arranged to form an angle with the main microstrip line.

17. Superconducting filter arrangement according to claim 16, wherein the resonator forms an angle of about 45° with the main microstrip line.

18. Superconducting filter arrangement according to claim 1, wherein the waveguide arrangement is a coplanar waveguide.

19. Superconducting filter arrangement according to claim 18, wherein coupling strength between the resonator and the coplanar waveguide is given by the width of the central strip and of the slots of the coplanar waveguide.

20. Superconducting filter arrangement according claim 1, wherein a DC-biasing voltage is applied via connection means between the upper plate of the resonator and the coupling means.

21. The superconducting filter arrangement according to claim 1, wherein said filter arrangement is used for filtering signals incoming to a receiving arrangement in a multichannel communications system to prevent interfering signals from being received in the receiving arrangement.

22. Superconducting filter for use in multichannel communications systems operating in high frequency bands comprising a waveguide arrangement and at least one resonator, wherein the resonator is a parallel-plate resonator comprising a non-linear dielectric material on which superconducting plates are arranged, and the waveguide arrangement comprises a microstrip line comprising contact means or coupling means, the resonator being so arranged in relation to the waveguide arrangement that a series resonant circuit is provided thus forming the filter, and connecting means are provided through which the filter can be frequency tuned.

23. Filter according to claim 22, wherein a DC-biasing voltage is applied via the connecting means.

24. Filter according to claim 22, wherein the microstrip line comprises a main microstrip line and a central microstrip forming said coupling means.

25. Filter according to claim 22, wherein the resonator comprises a non-linear dielectric bulk material plated with the superconducting plates, comprising high temperature super conductors.

26. Filter according to anyone of claim 22, wherein the resonator is a dual mode or a multimode resonator.

27. Filter according to claim 22, said filter comprising a two-pole notch filter.

28. Filter according to claim 22, wherein the resonator comprises a chip having an area of approximately between 1 $mm^2$–1 $cm^2$ at frequencies of about 0.1–0.2 GHz.

29. Method for filtering signals incoming to a receiving arrangement in a multichannel communications system comprising the steps of:

arranging a filter on an input side of the receiving arrangement, wherein said filter comprises a finite parallel plate resonator made of a non-linear dielectric material that has a high dielectric constant on which superconducting plates are arranged and which is arranged on a waveguide arrangement, the resonator having finite extensions contact means being provided between said resonator and said waveguide arrangement, to provide a coupling in series of the resonator and the microstrip line, arranging the resonator and the coupling means in relation to each other so that the needed coupling strength is provided, and applying a DC-biasing voltage between the resonator and the contact means for frequency tuning, so that interfering signals are not received in the receiving arrangement.

30. Method according to claim 29, comprising the step of giving the filter the desired coupling strength through giving the contact means or coupling means such dimensions in relation to the resonator that the desired coupling strength is obtained and the resonator comprises a non-linear dielectric bulk material plated with HTS-films.

* * * * *